US005857664A

United States Patent [19]

Schauman

[11] Patent Number: 5,857,664

[45] Date of Patent: Jan. 12, 1999

[54] FENCE SYSTEM

[76] Inventor: Tor Schauman, 11 Blue Creek Rd., Thompson Falls, Mont. 59873

[21] Appl. No.: 832,516

[22] Filed: Apr. 3, 1997

[51] Int. Cl.[6] ..... E04H 17/14

[52] U.S. Cl. ..... 256/19; 256/66; 256/1

[58] Field of Search ..... 256/19, 66, 59, 256/65, 1; 52/155, 156, 158, 165

[56] References Cited

U.S. PATENT DOCUMENTS

| | | | |
|---|---|---|---|
| 221,449 | 11/1879 | De Wolfe | 52/165 |
| 3,865,309 | 2/1975 | Greenhalgh | 256/1 X |
| 3,933,311 | 1/1976 | Lemelson | 256/1 X |
| 5,100,109 | 3/1992 | Robbins, III | 256/19 X |
| 5,165,663 | 11/1992 | Wells | 256/19 |

FOREIGN PATENT DOCUMENTS

| | | | |
|---|---|---|---|
| 606491 | 8/1948 | United Kingdom | 256/19 |

*Primary Examiner*—Anthony Knight
*Attorney, Agent, or Firm*—Harry M. Cross, Jr.

[57] ABSTRACT

A fence system comprises tubular plastic posts and at least one tubular plastic rail, the rail having multiple rail sections joined together end-to-end with plastic couplings, and the posts each having an anchor assembly slidably-fitting into a bottom of the post and extending axially from the post so that the anchor assembly may be driven into the ground by aligning the post to the ground and driving the anchor assembly through the post and into the ground. Each post is provided with at least one rail aperture having an opening on one side of the post that is slightly larger than the rail sections and having an opening on the other side of the post that is vertically oblong so as to permit a rail section to extend through the rail opening at a non-perpendicular angle without binding in the aperture. The anchor assembly comprises three elongated plastic tubes arranged to nest together parallel to one another, each tube having a beveled end arranged with respect to the nested-together assembly to provide a ground-piercing end for the anchor assembly.

6 Claims, 1 Drawing Sheet

FENCE SYSTEM

BACKGROUND OF THE INVENTION

1. Field of the Invention

This invention relates to fence systems for field fencing and, more particularly, to fence systems having plastic posts and rails.

2. Brief Description of the Prior Art

Although plastic fence systems have been heretofore proposed, they are usually not suitable for field fencing because of their cost.

SUMMARY OF THE INVENTION

It is a primary object of this invention to provide a plastic fence system that is composed of economical plastic parts and that is simple to erect in the field.

These and other objects and advantages will become apparent from the following description of the invention.

In accordance with these objects and advantages, the fence system of this invention comprises tubular plastic posts and at least one tubular plastic rail means, the rail means having multiple rail sections joined together end-to-end with plastic couplings, and the posts each having an anchor assembly means slidably-fitting into a bottom of the post and extending axially from the post so that the anchor assembly means may be driven into the ground by aligning the post to the ground and driving the anchor assembly means through the post and into the ground. Each post is provided with at least one rail aperture having an opening on one side of the post that is slightly larger than the rail sections and having an opening on the other side of the post that is vertically oblong so as to permit a rail section to extend through the rail opening at a non-perpendicular angle without binding in the aperture. The anchor assembly means comprises three elongated plastic tubes arranged to nest together parallel to one another, each tube having a beveled end arranged with respect to the nested-together assembly to provide a ground-piercing end for the anchor assembly means.

DESCRIPTION OF THE PREFERRED EMBODIMENT

Figure 1:
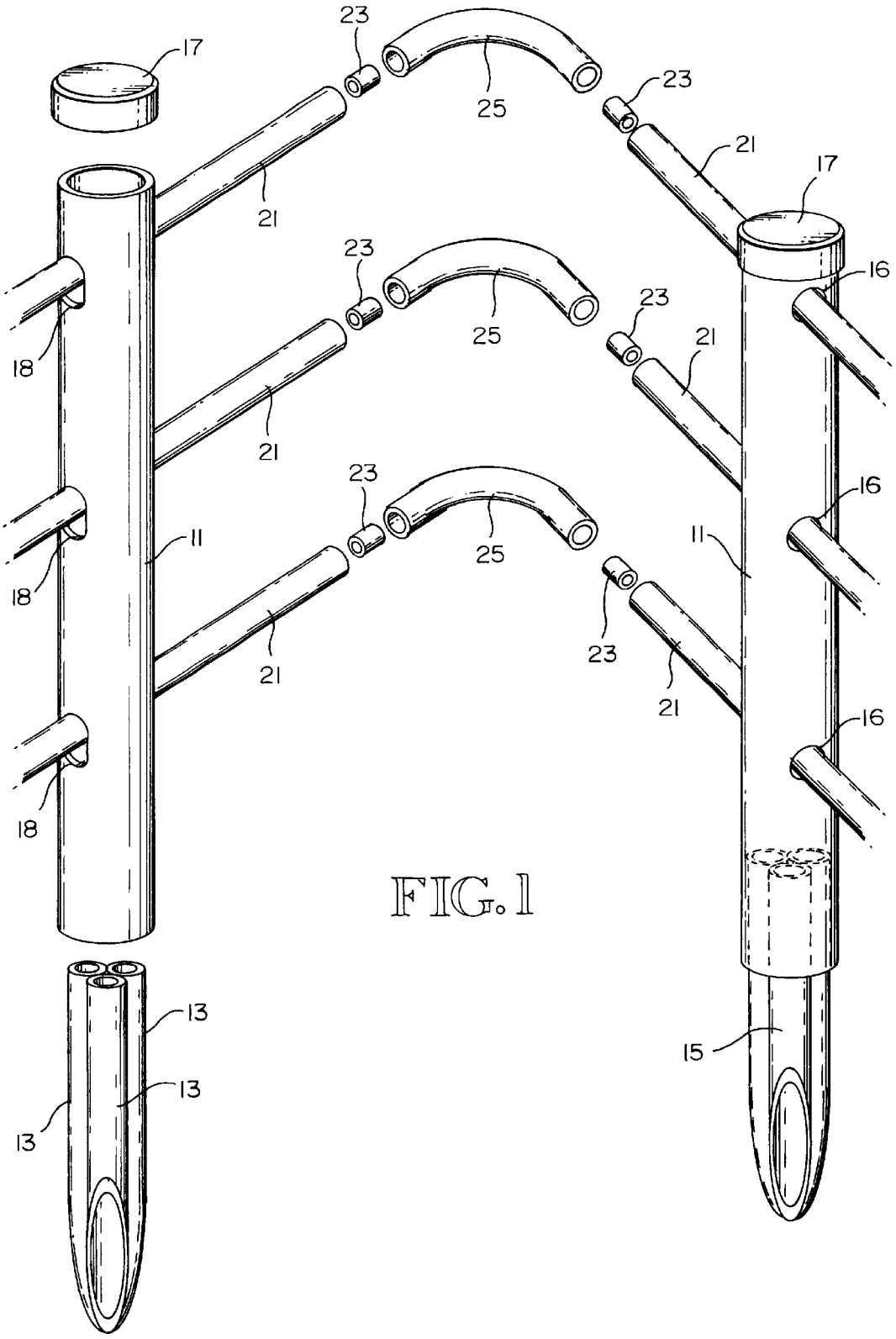
FIG. 1 is a stylized exploded perspective view of the components of the fence system of this invention.

The fence system of this invention comprises plastic tubular fence posts 11 and plastic tubular fence rails 21. The posts are provided with transverse apertures through which the rails 21 extend. These transverse apertures have openings 16 on one side of the posts that are approximately the same size as the rails 21 and have openings 18 on the other side that are elongated vertically. The two openings, 16 and 18, for each post aperture are aligned such that there upper edges are approximately aligned and such that the lower edge of the opening 18 is lower than the lower edge of opening 18. Sections of the rails 21 are coupled together by coupling sleeves 23. Fence rail corner sections 25 are provided and are connected to rail end sections by coupling sleeves 23, also. The corner sections 25 are curved so as to provide flexible connections to the straight rail sections 21.

Rail couplings 23 are preferably formed to have outer configurations matching the inner configurations of the rail sections 21 such that the couplings 23 are internal fittings.

When adjacent rails 21 are connected by means of an internal coupling 23, the joined rail sections will appear jointless, a desirable ornamental feature. The thus-connected rail sections 21 are effectively continuous rails. They extend uninterrupted through the post aperture openings 16 and 18. Providing opening 18 in an elongated form, relative to opening 16, for each post aperture enables a rail to extend through an aperture non-perpendicularly so that the rail can generally parallel the ground contour without binding in the post aperture.

To facilitate field assembly of the fence system, rail sections 21 and corner sections 25 may be provided with couplings 23 already connected at one end. Then, the assembler need only apply adhesive to the exposed end of a coupling 23, that protrudes beyond the rail or corner end, and install the free end of an adjacent rail section 21 or corner section 25 to the coupling 23.

The tubular rail sections 21, being hollow, can be used to carry water for irrigation or other purposes. The couplings 23 would be provided as hollow sleeves for this purpose. Generally, moreover, the preferred configuration of couplings 23 would be as hollow sleeves with OD's matching the rail section ID's.

When coupled together, multiple rail sections 21, forming a continuous rail, will expand and contract longitudinally, with varying ambient temperatures. The curved corner sections 25 will flex to accommodate such contractions and expansions. When a rail contracts, the curved corner 25 will straighten slightly to become less curved. Typically, the corner sections 25 will provide 90° corners with generally semicircular forms, and rail contraction will result in the corner sections 25 shifting inward and forming a flatter curved configuration.

The tubular posts 11 may be prefabricated with a rail apertures having the respective side openings 16, 18. Alternately, the posts 11 may be altered at the site by using a cutter, such as a router, to cut the apertures with the openings configured as shown in the drawing.

The posts 11 are preferably inserted over anchoring assemblies of the type shown in the drawing. Each anchoring assembly comprises three plastic tubes 13 that each have a tapered bottom end as shown to provide an oblong bottom opening. Typically, each tube 13 would be about 24 inches long with a bottom tapered end about 8 inches long, or about ⅓ the length of the tube. The tubes 13 are oriented so that their bottom end openings face outward as shown. The tube OD's are selected so that their combined circumference will fit within the tubular posts with a friction fit.

With this configuration, an anchoring assembly could be slipped into the bottom end of a post 11, the post oriented vertically for installation, and a down-the-post driver could be employed to pound the anchoring assembly into the ground while being centered by the post. Then the post could be adjusted up or down on the anchoring assembly to suit the fencing requirements of the fence system. Because of the beveled end of each tube 13 facing outward, the anchoring assembly is self-centering and will drive true in the direction of the post's longitudinal axis. The anchoring assembly may be driven far enough into the ground to become stabilized with enough length protruding above ground to hold the post as shown. The beveled edges of the tubes 13 will pierce the ground, with a column of earth extending up through each tube to aid in stabilizing the assembly.

After installation of the posts 11 onto the anchoring tubes 13, the posts could be capped with plastic caps 17 and the rail sections 21 inserted and assembled into continuous rails.

The corner sections 25 can be used as inside corners as shown or they may be used as outside corners. If one or more of the rails is to carry running water, appropriate fittings would be inserted into a rail section for attachment to a water supply and for attachment to discharge devices, such as sprinkler heads, faucets, or the like.

A typical installation would be comprised of 4 inch OD posts 11 having rail apertures with 2 inch openings at 16 and 2 inch×3 inch vertically oblong openings at 18, 1.9 inch OD rail sections 21 and corner sections 25, 1.9 inch OD anchor tubes 13 and 4 inch ID caps 17. Schedule 40 PVC pipe would be suitable for typical installations. During the pipe manufacturing process, the PVC may be treated so as to become UV resistant.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A fence system comprising tubular plastic posts and at least one tubular plastic rail means, said rail means having multiple rail sections joined together end-to-end with plastic couplings, and said posts each having an anchor assembly means slidably-fitting into a bottom of the post and extending axially from the post so that the anchor assembly means may be driven into the ground by aligning the post to the ground and driving the anchor assembly means through the post and into the ground; said anchor assembly means comprising three elongated plastic tubes arranged to nest together parallel to one another, each tube having a beveled end arranged with respect to the nested-together assembly to provide a ground-piercing end for the anchor assembly means.

2. A fence system comprising tubular plastic posts and at least one tubular plastic rail means, said rail means having multiple line rail sections joined together end-to-end with plastic couplings, and said posts each having an anchor assembly means slidably-fitting into a bottom of the post and extending axially from the post so that the anchor assembly means may be driven into the ground by aligning the post to the ground and driving the anchor assembly means through the post and into the ground; each post being provided with at least one rail aperture having an opening on one side of the post that is slightly larger than the rail sections and having an opening on the other side of the post that is vertically oblong so as to permit a rail section to extend through the rail opening at a non-perpendicular angle without binding in the aperture; and said anchor assembly means comprising three elongated plastic tubes arranged to nest together parallel to one another, each tube having a beveled end arranged with respect to the nested-together assembly to provide a ground-piercing end for the anchor assembly means.

3. The fence system of claim 2 wherein said couplings comprise tubular sleeves having an OD approximately the same as the ID of the rail sections.

4. The fence system of claim 2 wherein said rail means includes curved corner rail sections joined to adjacent rail sections by couplings; said curved corner rail sections comprising elongated curved flexible plastic tubing joined to adjacent line rail tubing segments with plastic couplings, the curved plastic tubing of said curved corner rail sections having lengths sufficient to enable said curved plastic tubing to elastically flex so as to accommodate temperature-induced lengthwise contractions and expansions of said line rail sections by bending whereby the curvature of said curved corner rail sections is altered when said rail sections contract and expand; said rail means being supported by said posts in a manner such that said line rail sections can contract and expand freely.

5. A plastic tubular post assembly which comprises a tubular plastic post and an anchor assembly, the anchor assembly comprising three elongated plastic tubes arranged to nest together parallel to one another, each tube having a beveled end arranged with respect to the nested-together assembly to provide a ground-piercing end for the anchor assembly means.

6. The post assembly of claim 5 wherein the anchor assembly slidably-fits into a bottom of the post and extends axially from the post so that the anchor assembly may be driven into the ground by aligning the post to the ground and driving the anchor assembly through the post and into the ground.

* * * * *